US010905184B2

(12) United States Patent
Schulz et al.

(10) Patent No.: US 10,905,184 B2
(45) Date of Patent: Feb. 2, 2021

(54) WINGED VISOR STIFFENER FOR HAT'S BRIM

(71) Applicants: Jurgen Schulz, Carlsbad, CA (US); Richard Knight, Carlsbad, CA (US)

(72) Inventors: Jurgen Schulz, Carlsbad, CA (US); Richard Knight, Carlsbad, CA (US)

( * ) Notice: Subject to any disclaimer, the term of this patent is extended or adjusted under 35 U.S.C. 154(b) by 0 days.

(21) Appl. No.: 15/341,802

(22) Filed: Nov. 2, 2016

(65) Prior Publication Data

US 2017/0071278 A1 Mar. 16, 2017

Related U.S. Application Data

(63) Continuation-in-part of application No. 14/096,905, filed on Dec. 4, 2013, now abandoned.

(51) Int. Cl.

| | |
|---|---|
| ***A42B 1/18*** | (2006.01) |
| ***A42B 1/06*** | (2006.01) |
| ***A42C 5/04*** | (2006.01) |
| ***A42B 1/04*** | (2006.01) |
| *A42B 3/22* | (2006.01) |

(52) U.S. Cl.

CPC ..... *A42B 1/063* (2013.01); *A42B 1/045* (2013.01); *A42B 1/062* (2013.01); *A42C 5/04* (2013.01)

(58) Field of Classification Search

CPC ..... A42B 1/008; A42B 1/062; A42B 1/205; A42B 3/0493; A42B 1/067; A42B 1/066; A42B 1/22; A42B 1/18; A42B 1/064; A42B 1/206; A42B 3/227; A42B 1/02; A42B 1/045; A42B 1/06; A42B 1/04; A42B 1/061; A42B 3/0406; A42B 3/105; A42B 5/00; A42B 1/004; A42B 1/063; A42B 1/08; A42B 1/12; A42B 3/003; A42B 3/22; A42B 3/225; Y10S 2/909; Y10S 2/918; Y10S 2/906; A41D 2400/26; A41D 13/1153; A41D 13/1184; A41D 2200/20; A45B 11/04

USPC ..... 2/175.1, 171.4, 209.5, 175.4, 195.5, 2/195.1, 195

See application file for complete search history.

(56) References Cited

U.S. PATENT DOCUMENTS

| | | | | | |
|---|---|---|---|---|---|
| 2,088,930 | A * | 8/1937 | Schwarz | A42B 1/02 | 2/175.5 |
| 2,416,062 | A * | 2/1947 | Mercer | A42B 1/205 | 2/175.5 |
| 2,834,019 | A * | 5/1958 | Cavanagh | A42B 1/02 | 2/175.5 |
| 3,346,876 | A * | 10/1967 | Hutton | A42B 1/062 | 2/10 |
| 4,096,590 | A * | 6/1978 | Keshock | A42B 1/201 | 2/175.2 |
| 4,549,316 | A * | 10/1985 | Johnson | A42B 1/201 | 2/195.1 |

(Continued)

*Primary Examiner* — Robert H Muromoto, Jr.

(74) *Attorney, Agent, or Firm* — John R. Ross, III.; John R. Ross

(57) ABSTRACT

A winged visor stiffener for a hat's bill. A flat horizontal front section is connected to two angled offset sections. Two flat horizontal wings are connected to the two angled offset sections. The winged visor stiffener is sewn into the hat's bill via a plurality of rows of tight stitching. The winged visor stiffener provides protection to the wearer's face from the sun while optimizing peripheral vision and prevents the bill from flopping up or down in wet and windy conditions.

9 Claims, 14 Drawing Sheets

(56) References Cited

U.S. PATENT DOCUMENTS 4,951,319 A * 8/1990 Phillips, Jr. ..... A42B 1/04 2/172
4,980,928 A * 1/1991 Ellis ..... A41D 3/08 2/172
5,481,759 A * 1/1996 Rinaldi ..... A42B 1/061 2/171.1
5,544,361 A * 8/1996 Fine ..... A42B 1/062 2/10
5,685,017 A * 11/1997 Kraft ..... A42B 1/067 2/10
5,694,647 A * 12/1997 Crickmore ..... A42B 1/067 2/10
5,732,410 A * 3/1998 Machson ..... A61F 9/02 128/857
5,790,986 A * 8/1998 Hall ..... A42B 1/066 2/172
5,862,523 A * 1/1999 Proctor ..... A42B 1/064 2/171
5,865,333 A * 2/1999 Wolfe ..... A45C 11/02 220/4.21
5,875,493 A * 3/1999 MacDonald ..... A01K 55/00 2/10
5,901,380 A * 5/1999 Mishal ..... A42B 1/067 2/10
5,933,871 A * 8/1999 Kraft ..... A42B 1/067 2/181.4
5,950,241 A * 9/1999 Gomez ..... A42B 1/201 2/172
6,012,172 A * 1/2000 Steffy ..... A42B 1/02 2/175.1
6,035,445 A * 3/2000 Lui ..... A42B 1/02 2/175.1
6,311,331 B1 * 11/2001 Park ..... A42B 1/063 2/175.1
6,463,592 B1 * 10/2002 Brooks ..... A42B 1/04 2/209.12
6,588,021 B2 * 7/2003 Kronenberger ..... A42B 1/062 2/175.2
6,704,940 B1 * 3/2004 Convery ..... A42B 1/02 2/175.1
6,728,972 B1 * 5/2004 Whitley ..... A42B 1/02 2/175.1
6,742,191 B2 * 6/2004 Yang ..... A42B 1/046 135/16
6,802,083 B2 * 10/2004 Yan ..... A42B 1/241 2/175.6
6,996,852 B1 * 2/2006 Cabrera ..... A42B 1/062 2/171
10,159,293 B2 * 12/2018 Sunness ..... A42C 1/08
10,299,526 B2 * 5/2019 DuCasse ..... A42B 1/067
2004/0194192 A1 * 10/2004 Cho ..... A42B 1/063 2/195.1
2006/0048272 A1 * 3/2006 Tison ..... A42B 1/22 2/175.1
2008/0295222 A1 * 12/2008 Cunliffe ..... A42B 1/061 2/175.2
2009/0119819 A1 * 5/2009 Thompson ..... A42B 1/062 2/209.13
2009/0172866 A1 * 7/2009 Chang ..... A42B 1/242 2/209.12
2009/0229028 A1 * 9/2009 Dobkins ..... A42B 1/247 2/10
2010/0132092 A1 * 6/2010 Temblador ..... A42B 1/008 2/182.8
2011/0099691 A1 * 5/2011 Duwyn-Zylstra ..... A42B 1/22 2/175.1
2011/0145977 A1 * 6/2011 Oates ..... A42B 1/18 2/182.8
2011/0167544 A1 * 7/2011 Kim ..... A42B 3/227 2/421
2011/0252539 A1 * 10/2011 Scott ..... A42B 1/062 2/209.5
2012/0198600 A1 * 8/2012 Niazi ..... A42B 1/02 2/175.1
2012/0210491 A1 * 8/2012 Bryan ..... A42B 3/0406 2/181.4
2013/0326791 A1 * 12/2013 Woo ..... A42B 1/062 2/172
2014/0338098 A1 * 11/2014 Kelly ..... A42B 1/063 2/195.1
2015/0150328 A1 * 6/2015 Knight ..... A42C 5/04 2/175.1
2018/0352889 A1 * 12/2018 Schulz ..... A42C 5/04
2019/0098951 A1 * 4/2019 Schulz ..... A42B 7/00

* cited by examiner

WINGED VISOR STIFFENER FOR HAT'S BRIM

The present invention relates to hats and caps, and in particular, to hat and cap visors. The present invention is a Continuation-in-Part (CIP) application of U.S. patent application Ser. No. 14/096,905, filed Dec. 4, 2013, all of which is incorporated by reference herein.

BACKGROUND OF THE INVENTION

Hats, caps and other head coverings are well known and have existed for many centuries. There are many styles and types of hats. Some are designed for warmth and some are designed for fashion. A primary reason for the wearing of hat is to provide protection from the sun. With the increase of skin cancers and sun related skin problems it is essential to protect the skin. A hat with a very wide brim, such as a sombrero, provides excellent protection from the sun. However, the sombrero is a very large hat and is not very fashionable or practical in modern society. Smaller hats with smaller brims are easier to wear but do not provide optimum protection.

FIG. 1 shows a woman wearing a prior art hat 50. Hat 50 is a soft hat and is comfortable. However, it includes a brim that does not provide optimum protection from the sun for windy or wet conditions. If the brim of hat 50 were to get wet it could begin to droop and could cause loss of vision. Also, in windy conditions the brim could flow up and down, exposing the wearer's face.

What is needed is a device to make hats function better in protecting the wearer's face against harmful sun rays, and for preventing a hat's brim from flopping up and down in wet and windy conditions while also optimizing peripheral vision.

SUMMARY OF THE INVENTION

The present invention provides a winged visor stiffener for a hat's brim. A flat horizontal front section is connected to two angled offset sections. Two flat horizontal wings are connected to the two angled offset sections. The winged visor stiffener is sewn into the hat's brim via a plurality of rows of tight stitching. The winged visor stiffener provides protection to the wearer's face from the sun while optimizing peripheral vision and prevents the bill from flopping up or down in wet and windy conditions.

DETAILED DESCRIPTION OF THE PREFERRED EMBODIMENTS

Figure 1:
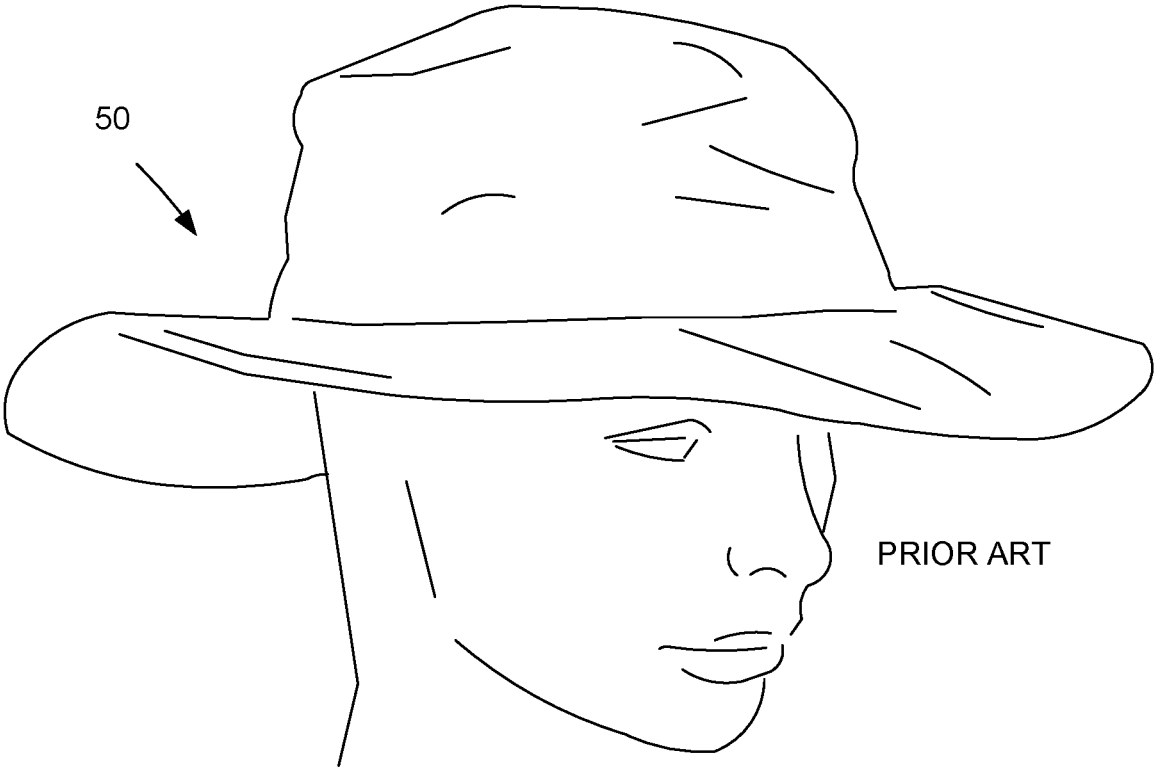
FIG. 1 shows a prior art hat.
Figure 2:
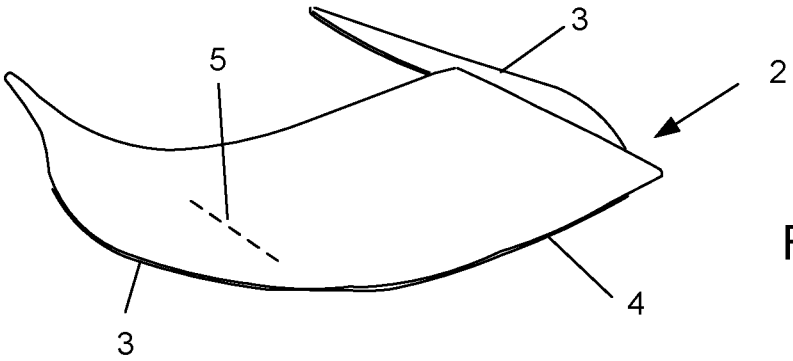
FIGS. 2-4 show a preferred winged visor.
Figure 3:
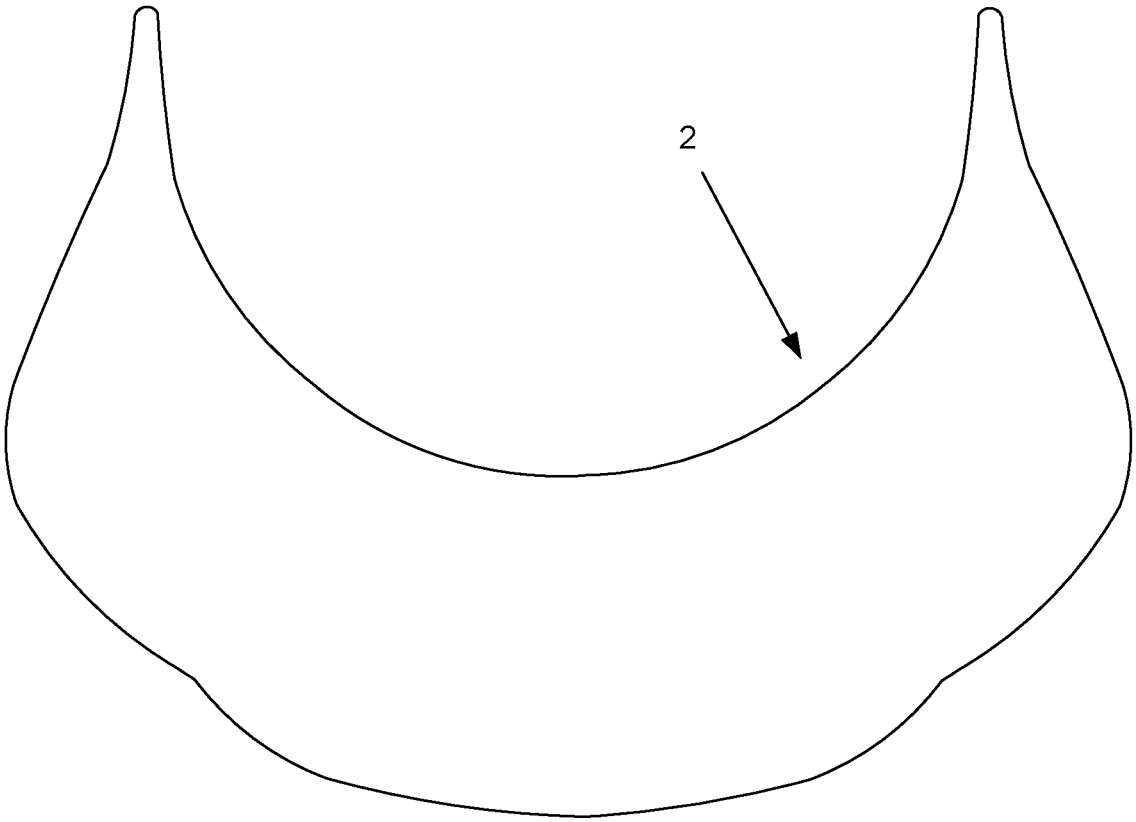
Figure 4:
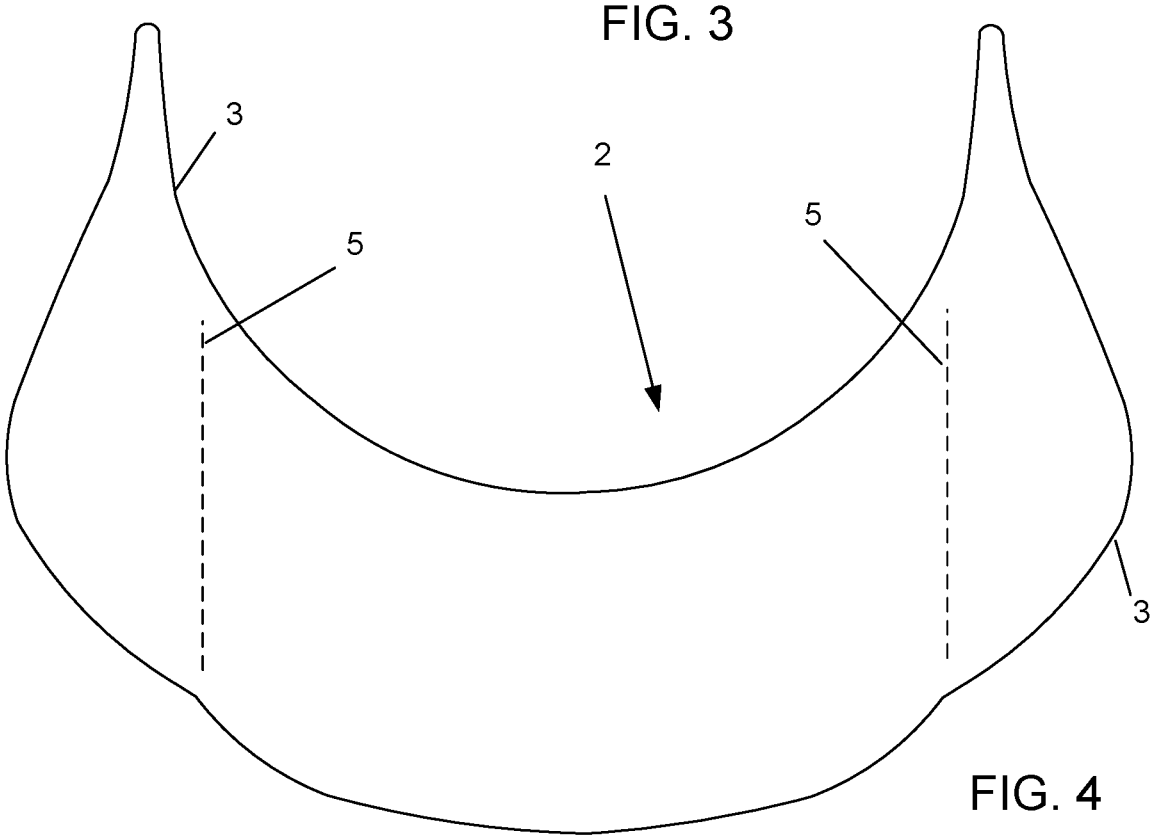
Figure 12:
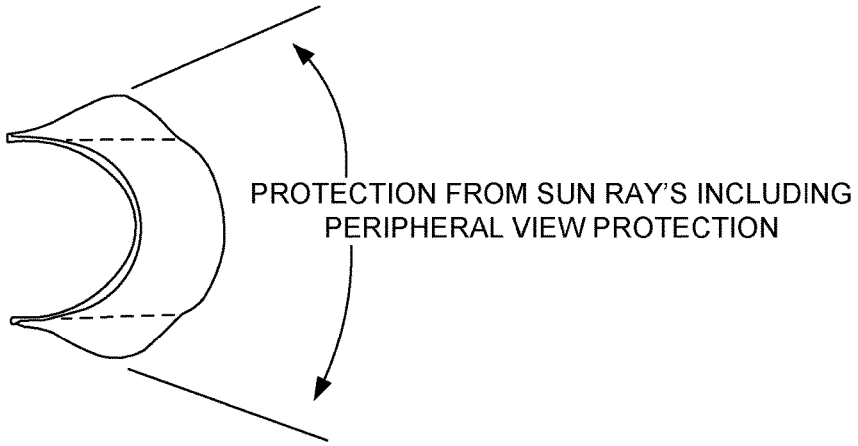
FIG. 12 shows a protection range of a preferred winged visor.

FIGS. 2-4 show a preferred embodiment of the present invention. Winged visor 2 has been cut from a flat sheet of strong, thin bendable plastic in the preferred shape shown in FIG. 3. Winged visor 2 is then bent along creases 5 (FIG. 4) to obtain the shape shown in FIG. 2. Winged visor 2 includes a curved front section 4 and side wings 3. Winged visor 2 provides for an increased range of protection from the sun (FIG. 12). Also, because wings 3 are horizontal they do not interfere with the peripheral vision of the wearer. Also, winged visor 2 prevents a hat's brim from flopping up or down in wet and windy conditions.

Figure 5:
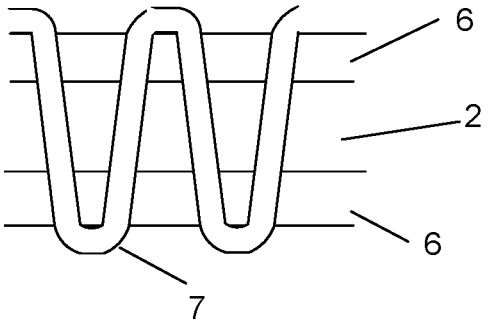
FIG. 5 shows a winged visor as a stiffener.

In a preferred embodiment, winged visor 2 is utilized as a stiffener for the bill of a ball cap, visor or hat. For example, as shown in FIG. 5 winged visor 2 is sewn into bill material 6 by utilization of thread 7 to form a stiffener for the bill. Winged visor 2 retains its shape after being sewn into the bill to provide optimum sun protection in wet and windy conditions.

Figure 6:
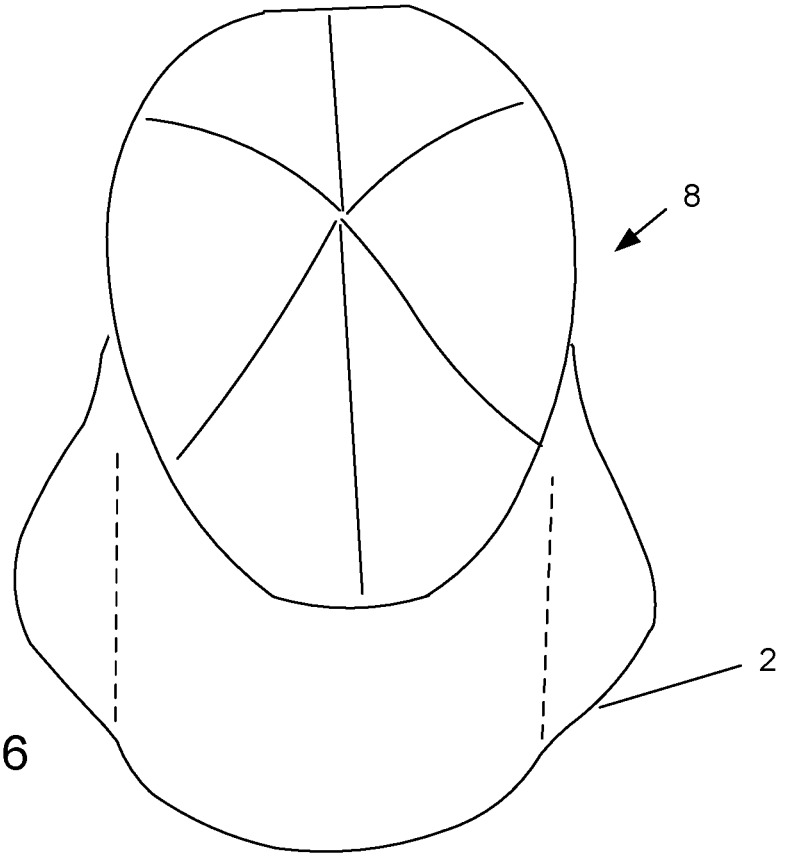
FIGS. 6-7 show a winged visor sewn into the bill of a ball cap.
Figure 7:
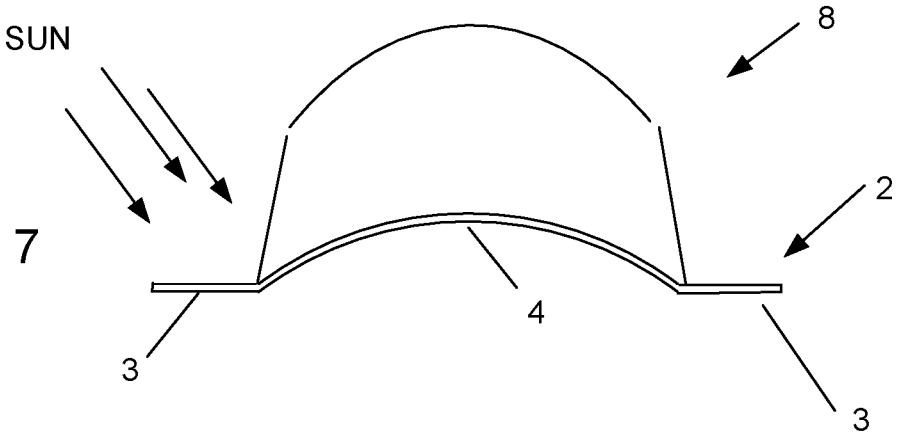

FIGS. 6 and 7 show a preferred ball cap 8. Ball cap 8 includes winged visor 2. Wings 3 of winged visor 2 provide additional protection from the sun in wet and windy conditions while also allowing for increased viewing for the wearer. Additionally, curved section 4 allows for optimum viewing forward.

Figure 8:
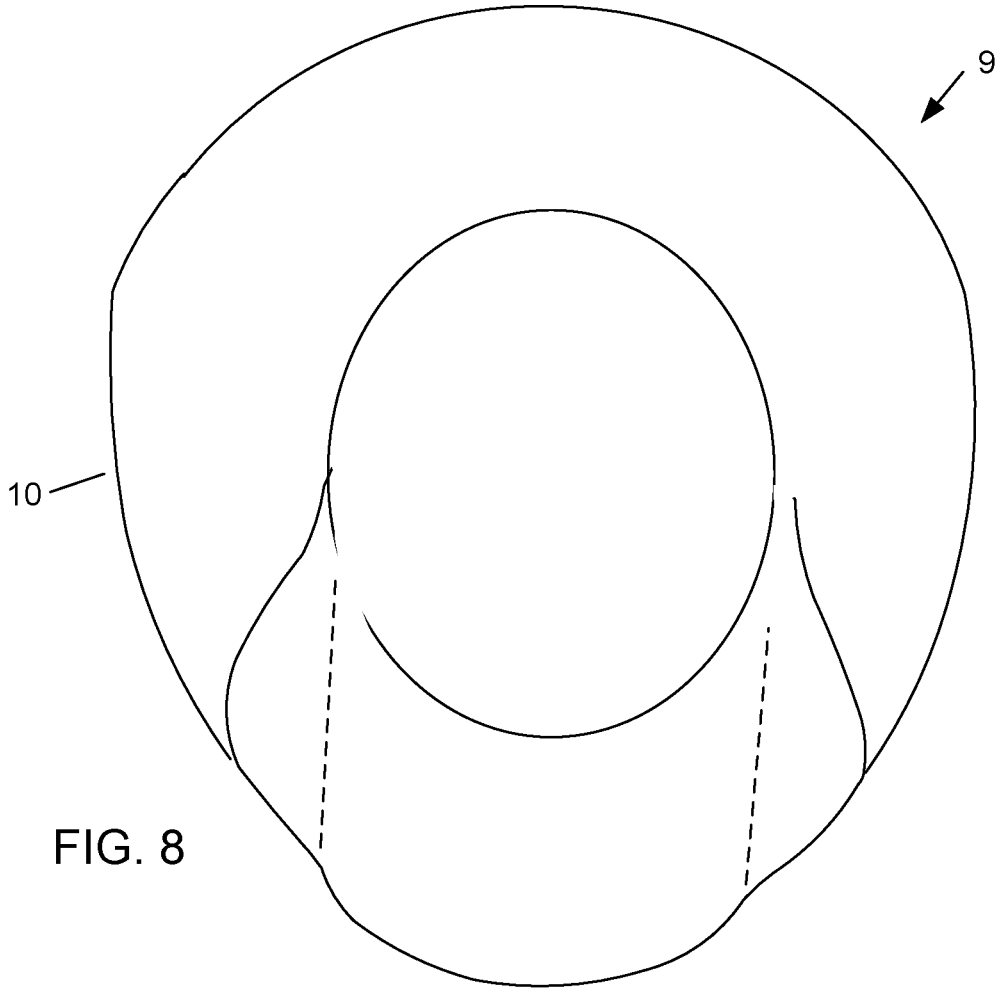
FIGS. 8-9 show a winged visor sewn into the brim of a wide brim hat.
Figure 9:
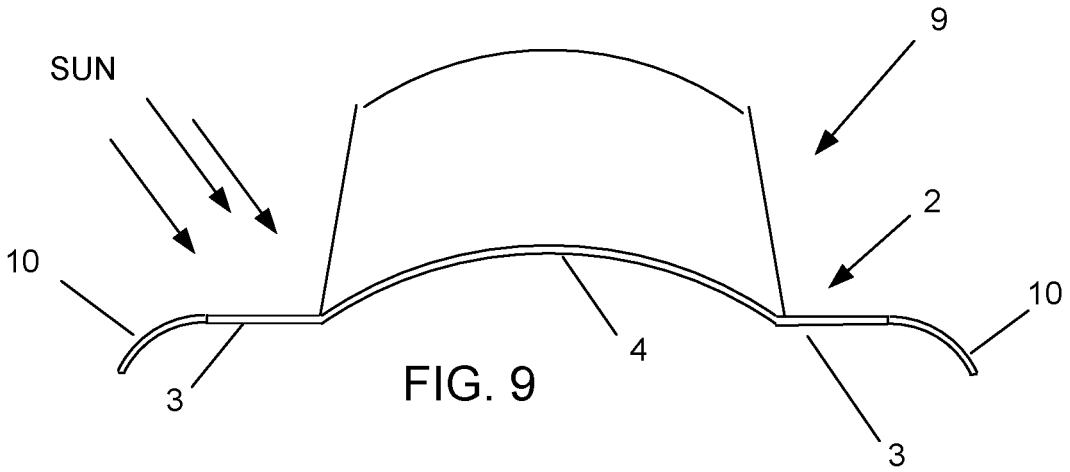

FIGS. 8 and 9 show a preferred wide brim hat 9. Wide brim hat 9 includes winged visor 2. Wings 3 of winged visor 2 provide additional protection from the sun in wet and windy conditions while also allowing for increased viewing for the wearer. Additionally, curved section 4 allows for optimum viewing forward. Soft, flexible fabric of brim 10 is kept away from the wearer's face by wings 3.

Figure 10:
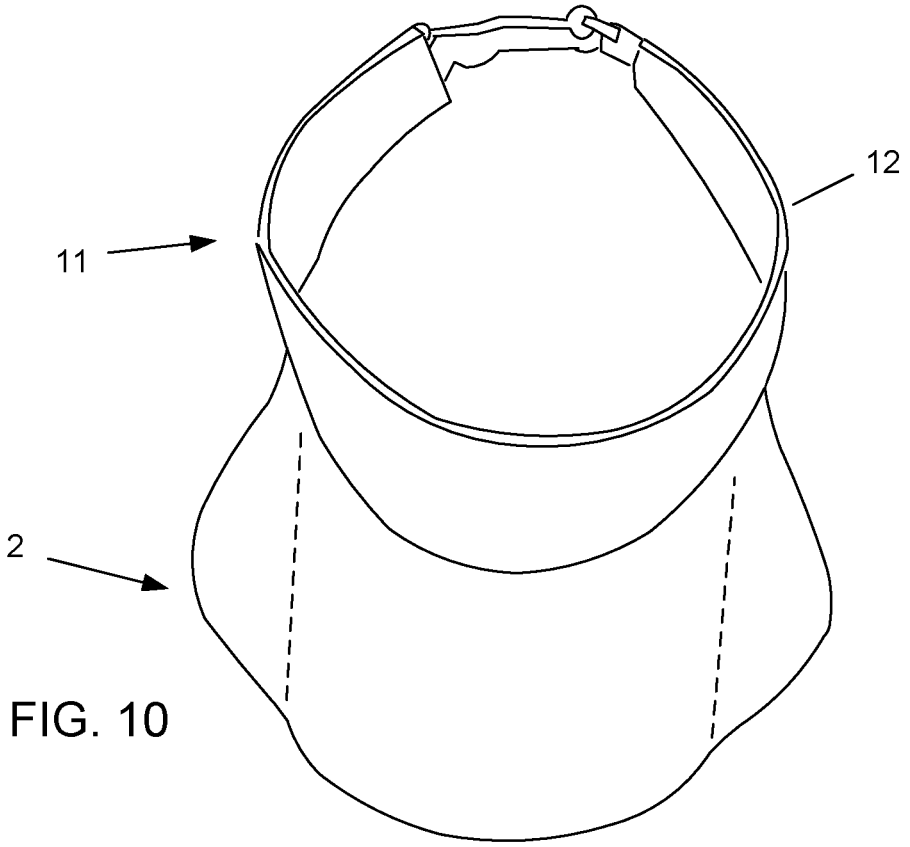
FIGS. 10-11 show a winged visor sewn into the brim of a visor.
Figure 11:
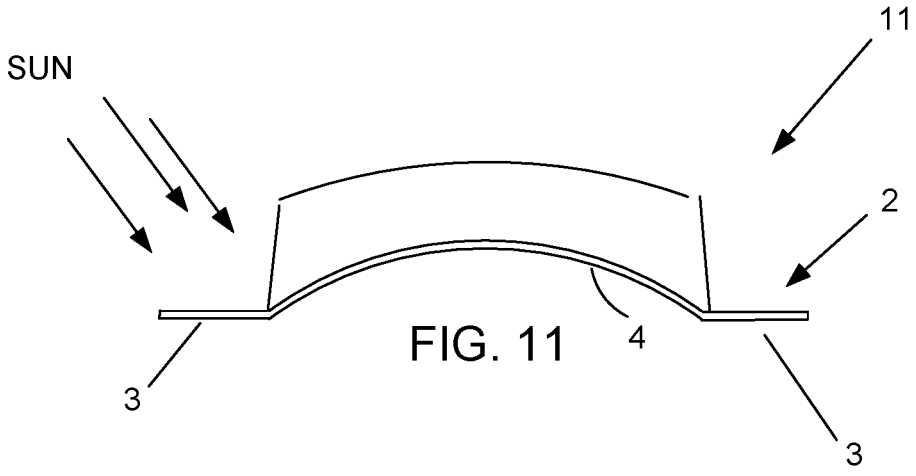

FIGS. 10 and 11 show a preferred visor 11. Visor 11 with head band 12 includes winged visor 2. Wings 3 of winged visor 2 provide additional protection from the sun while also allowing for increased viewing for the wearer. Additionally, curved section 4 allows for optimum viewing forward.

Figure 13:
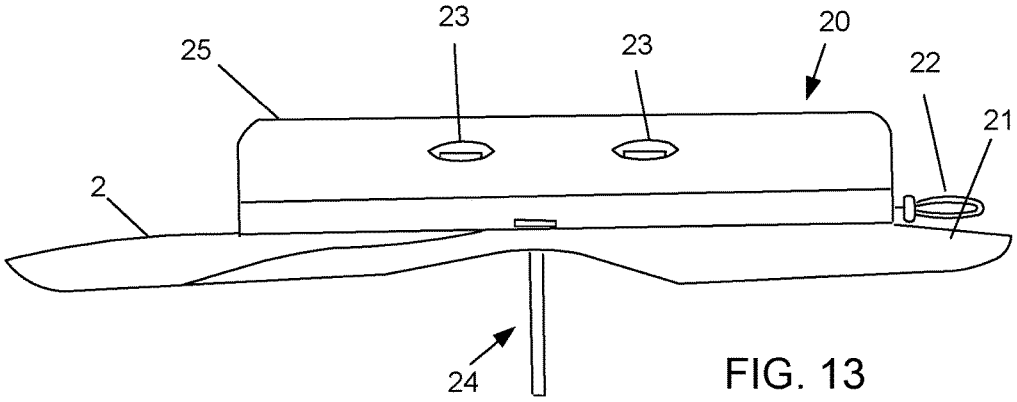
FIG. 13 shows a preferred embodiment of the present invention.
Figure 17:
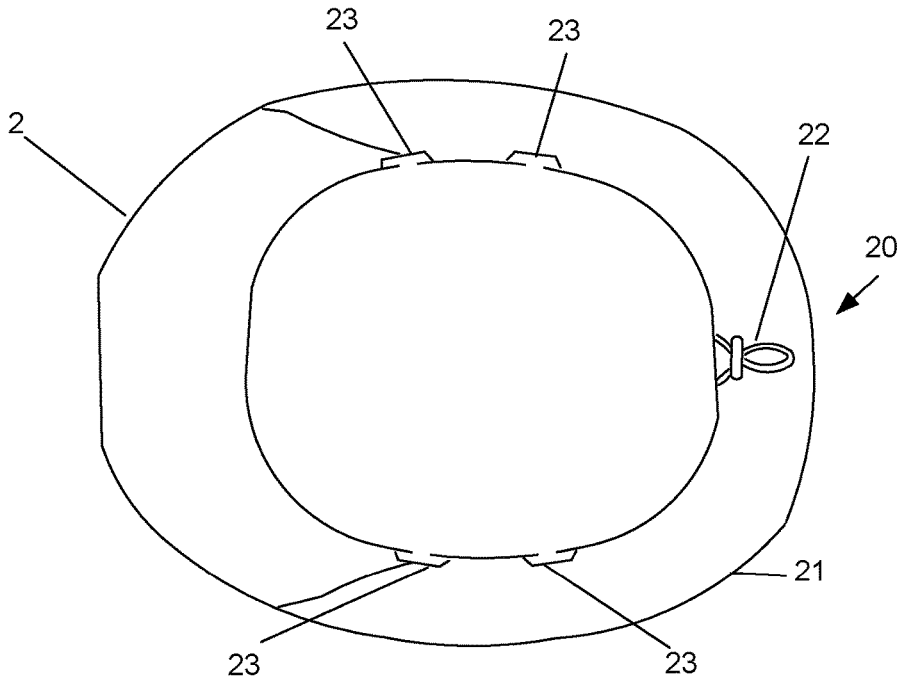
FIGS. 17-18 show a preferred embodiment of the present invention.
Figure 18:
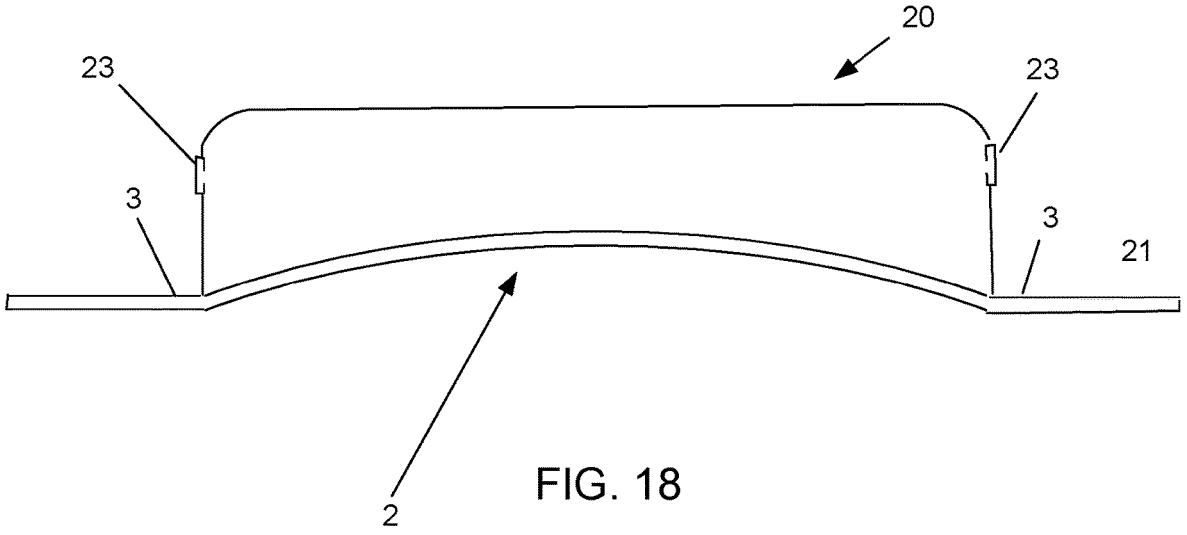

FIGS. 13, 17-18 show another preferred embodiment of the present invention. Wide brim hat 20 includes winged visor 2 sewn into the brim 21. Hat 20 includes crown adjustment strap 22 that can be tightened or loosened to adjust the pressure on the wearer's head. Hat 20 also includes eyelets 23 to allow for increased ventilation and comfort to the wearer. Removable chin strap 24 is inserted through brim 21 as shown.

Figure 14:
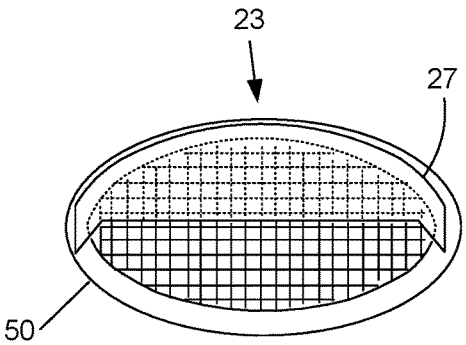
FIGS. 14-16 show a preferred eyelet.
Figure 15:
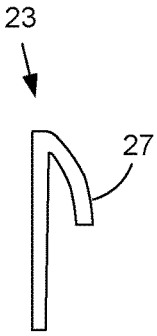
Figure 16:
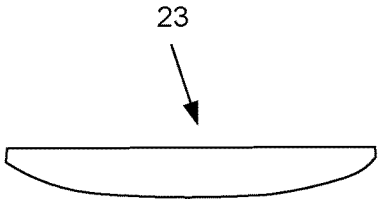

FIGS. 14-16 show a front view, side view and top view of a preferred eyelet 23. Preferably four eyelets 23 are sewn into crown 25 of hat 20. Eyelet 23 includes mesh fabric 26 partially covered by plastic cover 27. Plastic cover 27 is rigidly connected to elliptical plastic frame 50. Mesh fabric 26 allows for good ventilation while also keeping sun rays, unwanted insects and debris from entering the hat.

Figure 30:
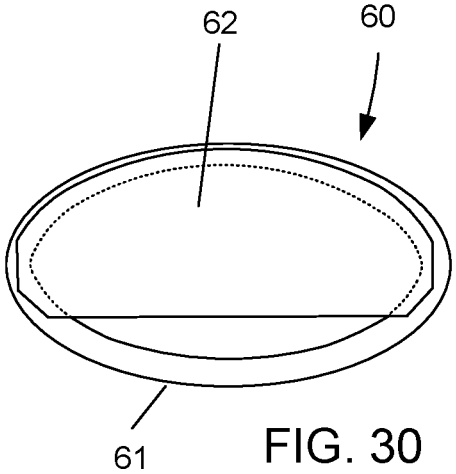
FIG. 30-32 show another preferred eyelet.
Figure 31:
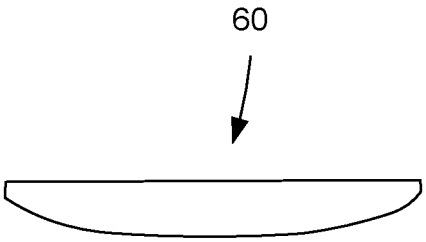
Figure 32:
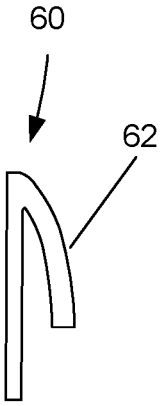

FIGS. 30-32 show preferred eyelet 60. Eyelet 60 includes a ventilation opening bordered by elliptical plastic frame 61 and partially covered by plastic cover 62. Plastic cover 62 is rigidly connected to elliptical plastic frame 61. The ventilation opening allows for good ventilation while plastic cover 62 functions to keep sun rays, unwanted insects and debris from entering the hat.

Figure 33:
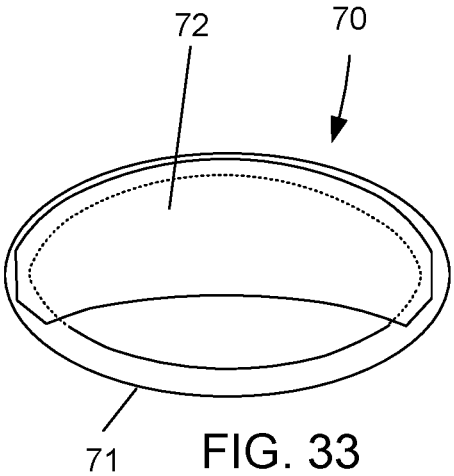
FIGS. 33-35 show another preferred eyelet.
Figure 34:
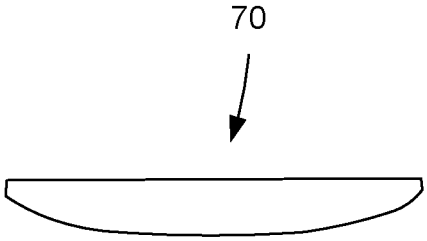
Figure 35:
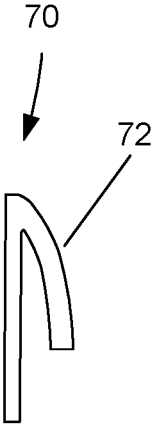

FIGS. 33-35 show preferred eyelet 70. Eyelet 70 is similar to eyelet 60 except that plastic cover 72 is curved at its bottom. Eyelet 70 includes a ventilation opening bordered by elliptical plastic frame 71 and partially covered by plastic cover 72. Plastic cover 72 is rigidly connected to elliptical plastic frame 71. The ventilation opening allows for good ventilation while plastic cover 72 functions to keep sun rays, unwanted insects and debris from entering the hat.

Figure 19:
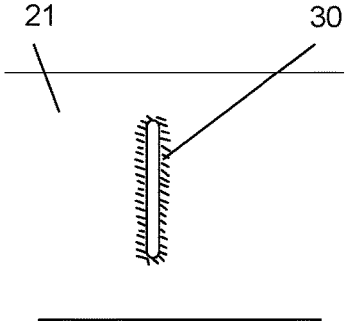
FIGS. 19-23 show a preferred removable chin strap.
Figure 20:
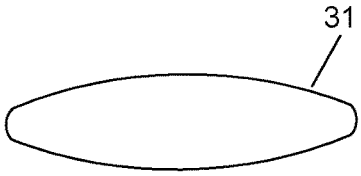
Figure 21:
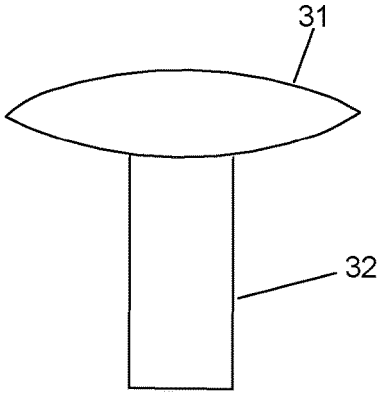
Figure 22:
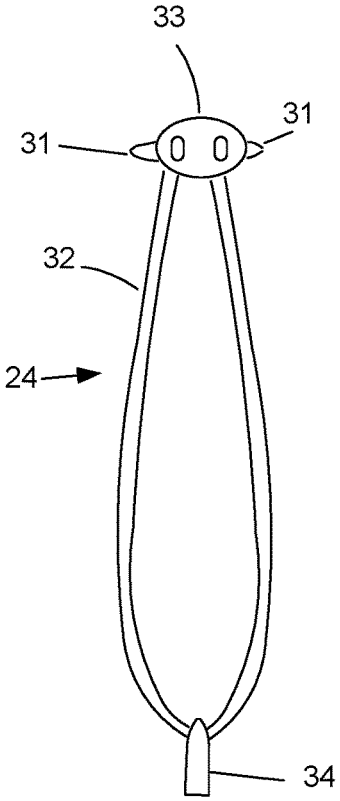
Figure 23:
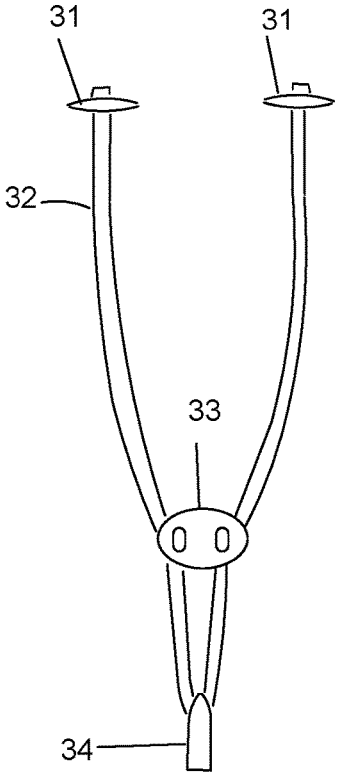

FIG. 19 shows slot 30 sewn into brim 21. Slot 30 allows for the insertion of plastic end piece 31 of removable chin strap 24. Strap 32 is connected to end pieces 31 and is threaded though strap position lock device 33. Also, strap 32 is threaded through alligator clip 34 as shown. Alligator clip 34 allows for chin strap 24 to function as a leash. For example, the wearer can attach alligator clip 34 to clothing he is wearing to prevent hat 20 from being blown away.

Figure 24:
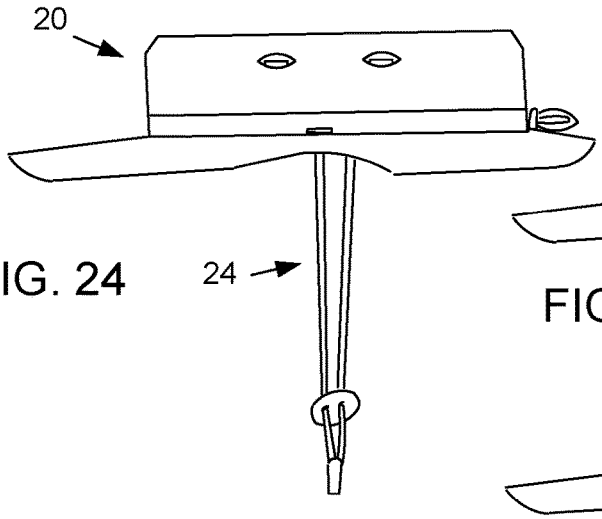
FIGS. 24-29 show methods of connecting a preferred removable chins strap.
Figure 27:
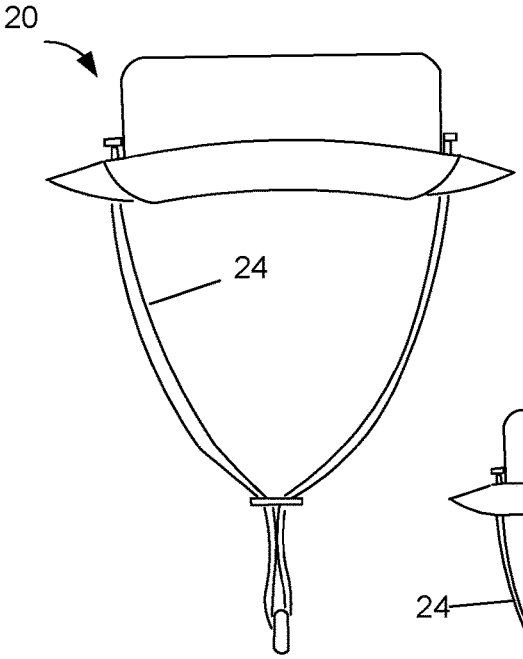
Figure 28:
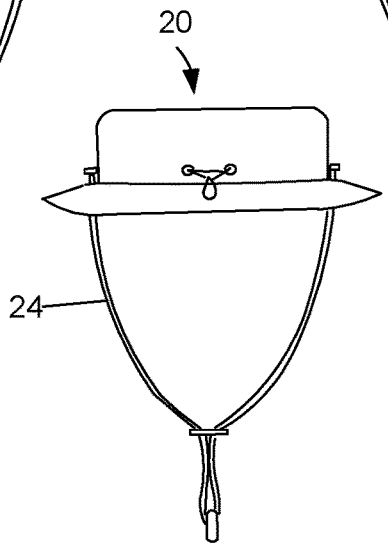

FIGS. 24, 27 and 28 show removable chin strap 24 in its normal position attached to hat 20. It should also be noted that the strap can be attached in many other ways, including military style, lanyard style. Additionally the strap can be removed altogether.

Figure 26:
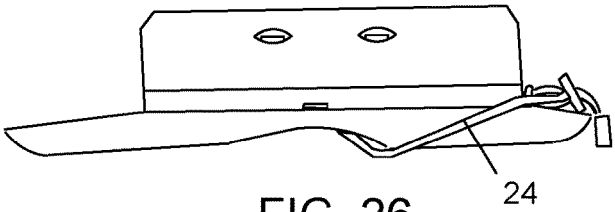

In FIG. 26 chin strap 24 has been moved from its position in FIG. 24 and repositioned so that it rests on the rear portion of brim 21 and out of the way of the wearer.

Figure 25:
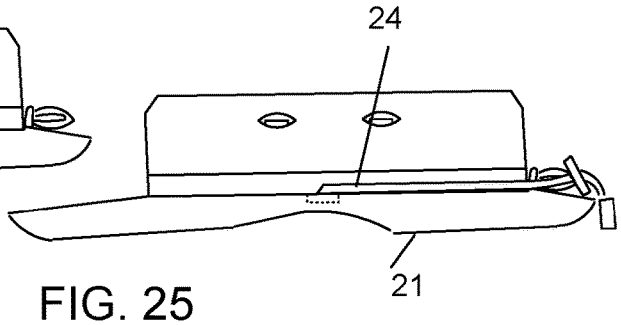

In FIG. 25 chin strap 24 has been removed and the reinstalled so that end pieces 31 are inserted through slots 30 (FIG. 19) and are underneath brim 21. Chin strap 24 has been positioned so that it rests on the rear portion of brim 21 and out of the way of the wearer.

Figure 29:
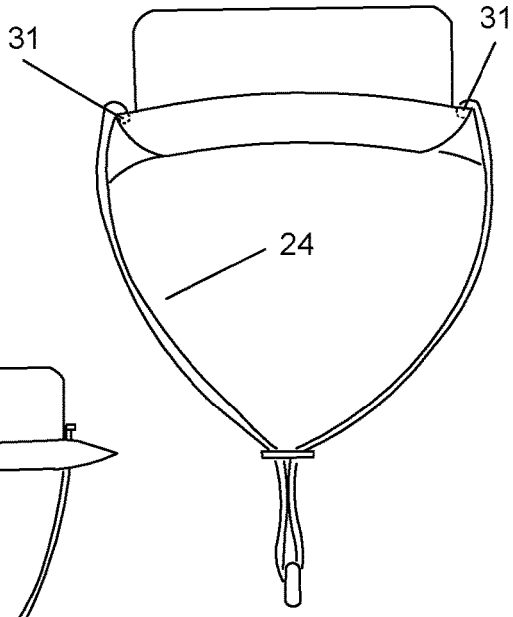

In FIG. 29 chin strap 24 has been removed and the reinstalled so that end pieces 31 are inserted through slots 30 (FIG. 19) and are underneath brim 21. Chin strap 24 runs over the top of brim 21 so that the side area of brim 21 presses downward towards the wearer's ears to provide increased ear protection for the wearer.

Other Preferred Embodiment

Figure 36:
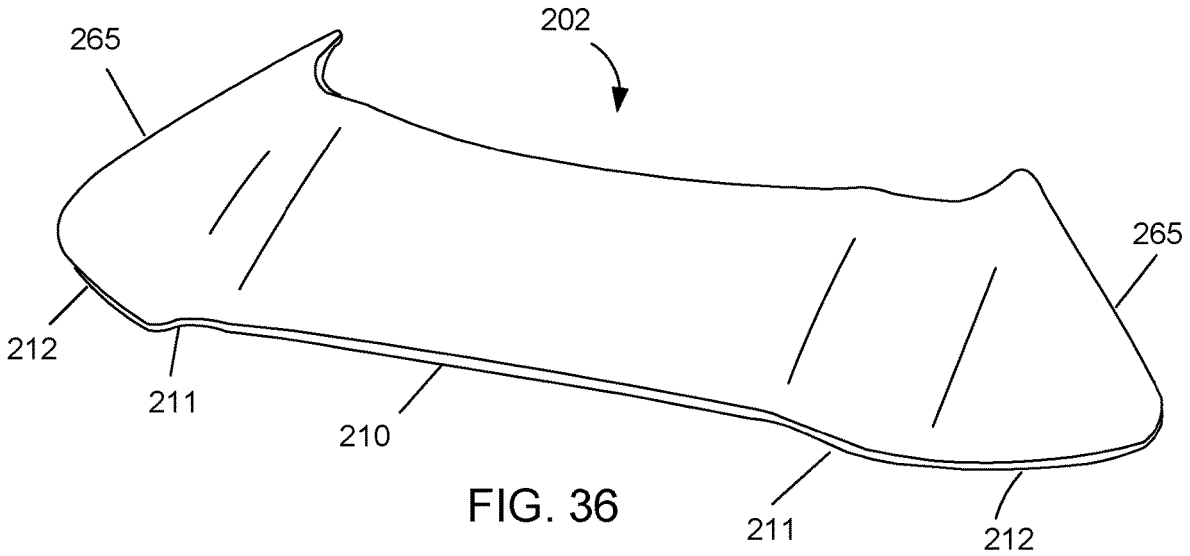
FIGS. 36-37*b* show another preferred winged visor.
Figure 37:
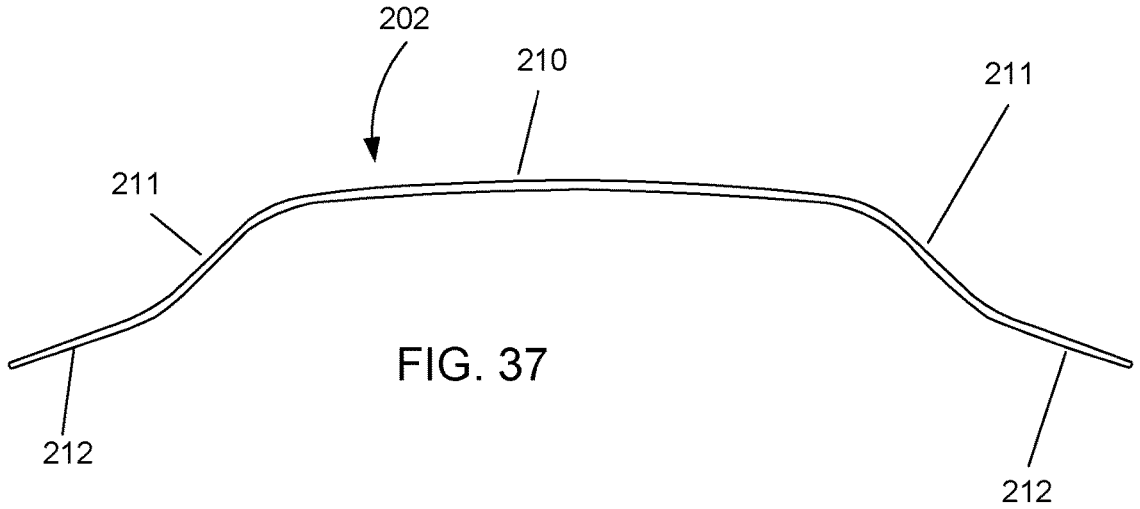
Figure 37B:
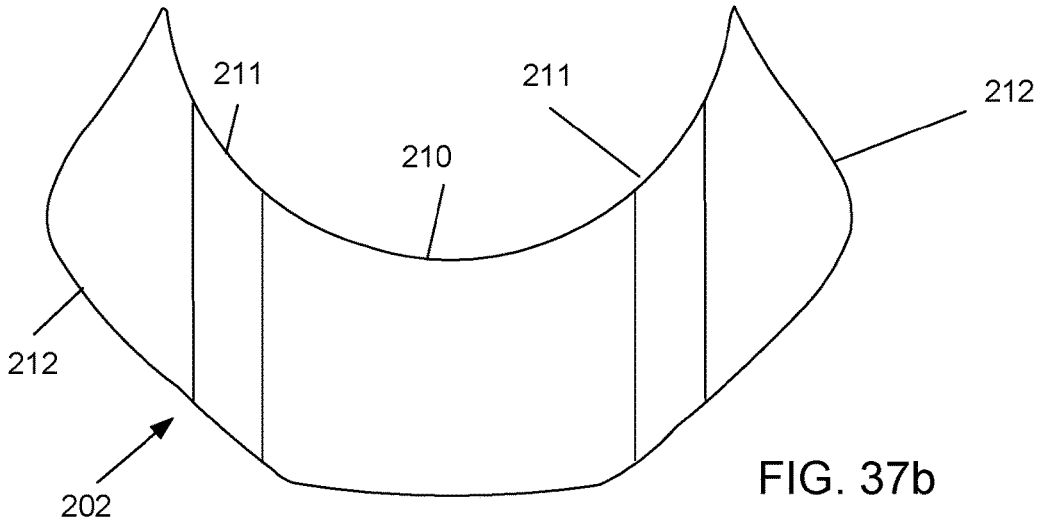

A perspective view of winged visor 202 is shown in FIG. 36, a front view of winged visor 202 is shown in FIG. 37 and a top view of winged visor 202 is shown in FIG. 37*b*. Winged visor 202 has been formed in a mold so that it is in the preferred shape shown in FIGS. 36 and 37. In a preferred embodiment, winged visor 2 includes a front section 210, two angled offset sections 211, and two side wings 212. In one preferred embodiment, back side wing edge 265 is approximately at least 3 inches to provide optimum sun protection. In another preferred embodiment back side wing edge 265 is approximately 2½ inches. This length may be further varied depending upon the preference of the user. In a preferred embodiment shown in FIGS. 36-37*b*, prior to being sewn into brim 215 of hat 220, front section 210 is slightly curved.

Figure 38:
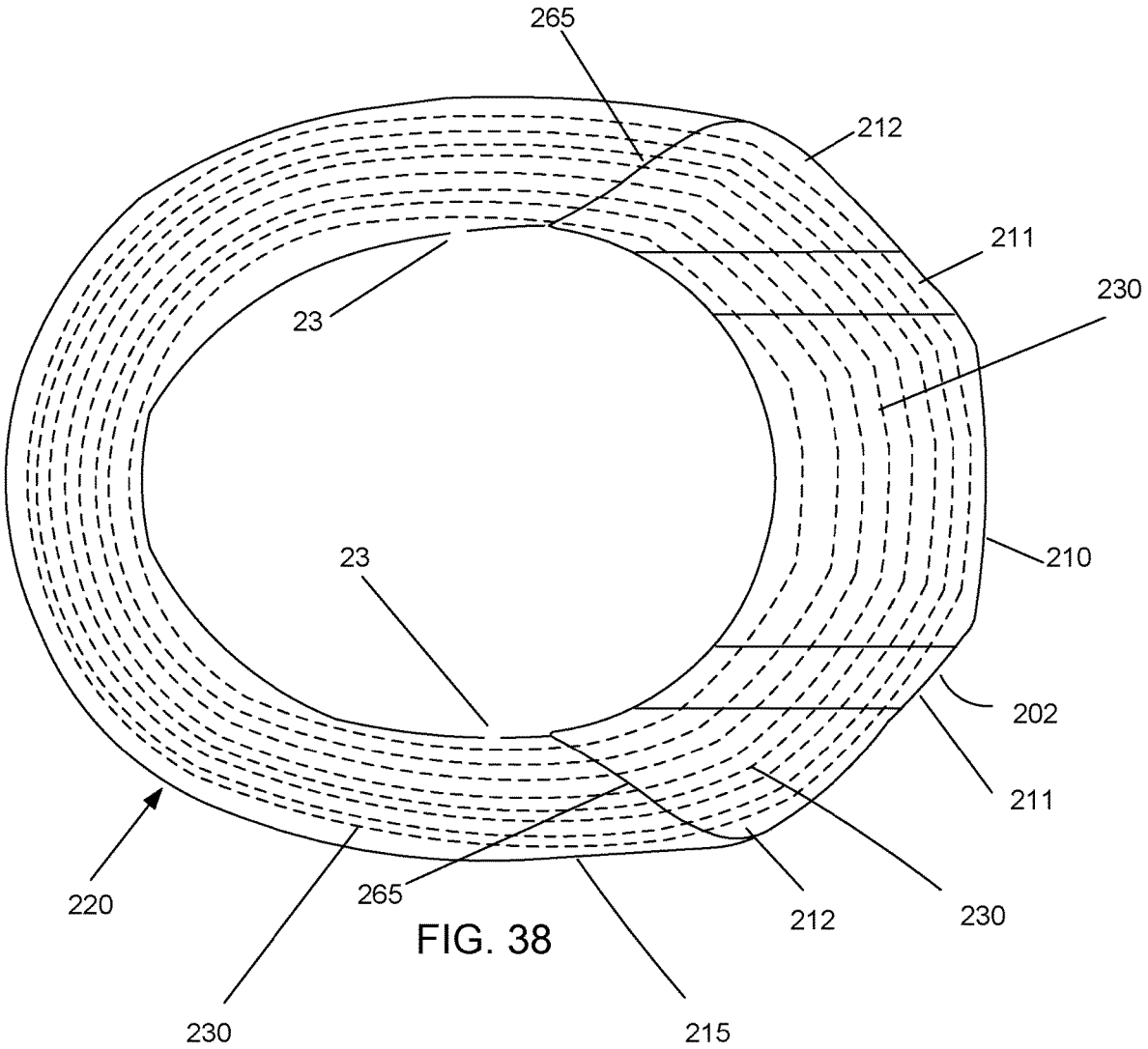
FIG. 38 shows a preferred winged visor sewn into a hat's bill.
Figure 39:
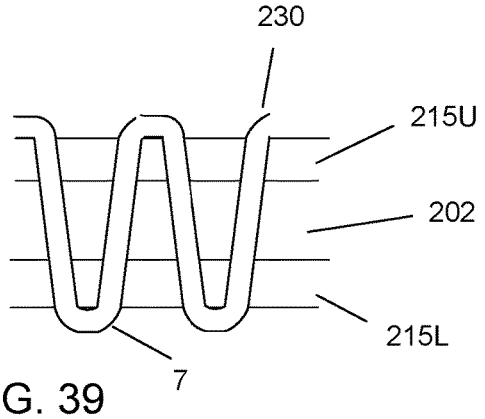
FIG. 39 shows preferred stitching.

Plastic bendable winged visor 202 is then sewn into brim 215 of hat 220 using thread 230 (FIGS. 38 and 39). FIG. 38 shows a top view of winged visor 202 sewn into brim 215. Upper brim cloth section 215U is shown covering winged visor 202. In the preferred embodiment shown in FIG. 38, there are eight rows of tight stitching 230 sewing together winged visor 202, upper brim cloth section 215U and lower brim cloth section 215L. In other preferred embodiments, the number of rows of stitching may be more or less depending upon the preferences of the user. As shown in FIG. 38, winged visor 202 only is sewn into the section of brim 215 that is meant to prevent flopping up or down in front of the user's face. At the rear part of brim 215 upper brim cloth section 215U is sewn directly adjacent to lower brim cloth section 215L with nothing between.

As shown in FIG. 39, winged visor 202 is sandwiched between upper brim cloth section 215U and lower brim cloth section 215L. After being sewn into brim 215, the tight stitching of thread 230 causes the two side wings 212 and the front section 210 to flatten out and become horizontal (FIG. 40), providing optimum protection for the user and for preventing the brim from flopping up and down in front of the user's face.

Figure 40:
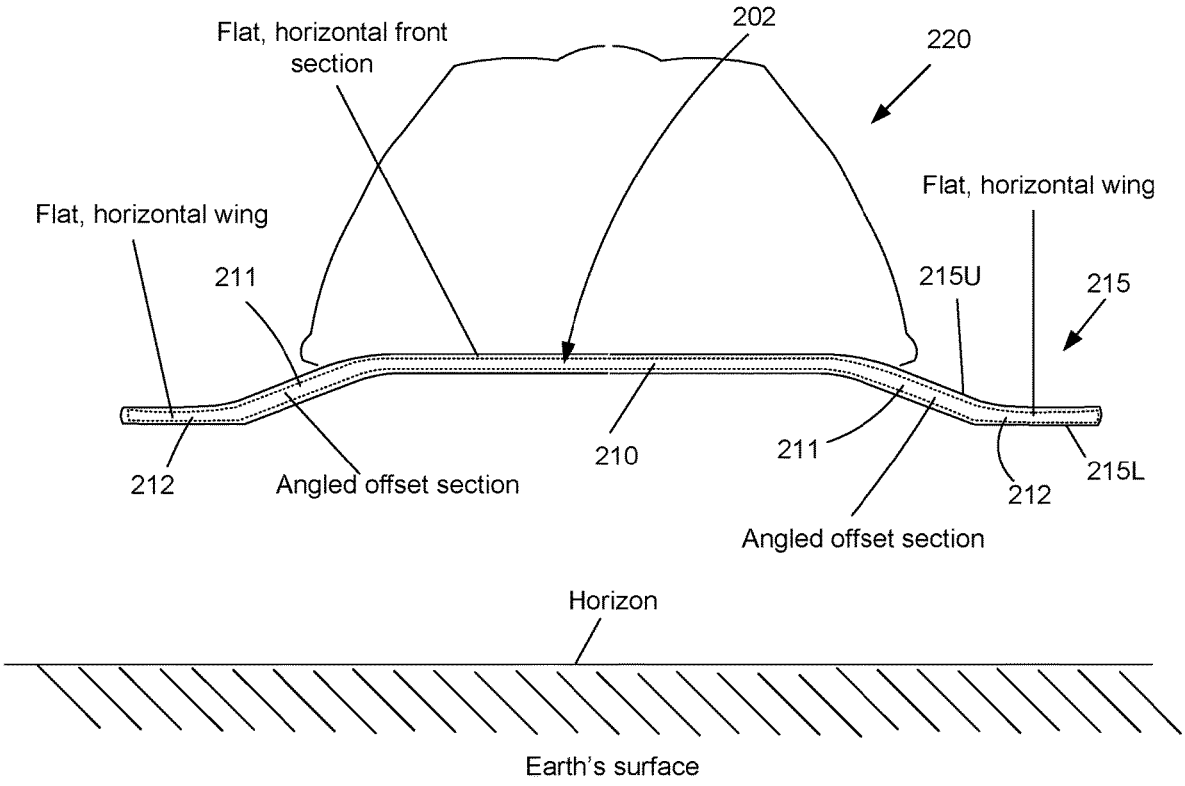
FIGS. 40-41 show a preferred embodiment of the present invention.

As shown in FIG. 40 horizontal wings 212 are roughly parallel to the horizon when worn flush on a user's head. Front flat section 210 is also roughly parallel to the horizon when worn on a user's head. Front flat horizontal section 210 and horizontal wings 212 provide optimum comfort and protection to the user's face and prevents brim 215 from flopping up or down. Angled offset sections 211 connect front flat section 210 to horizontal wings 212 as shown.

Figure 41:
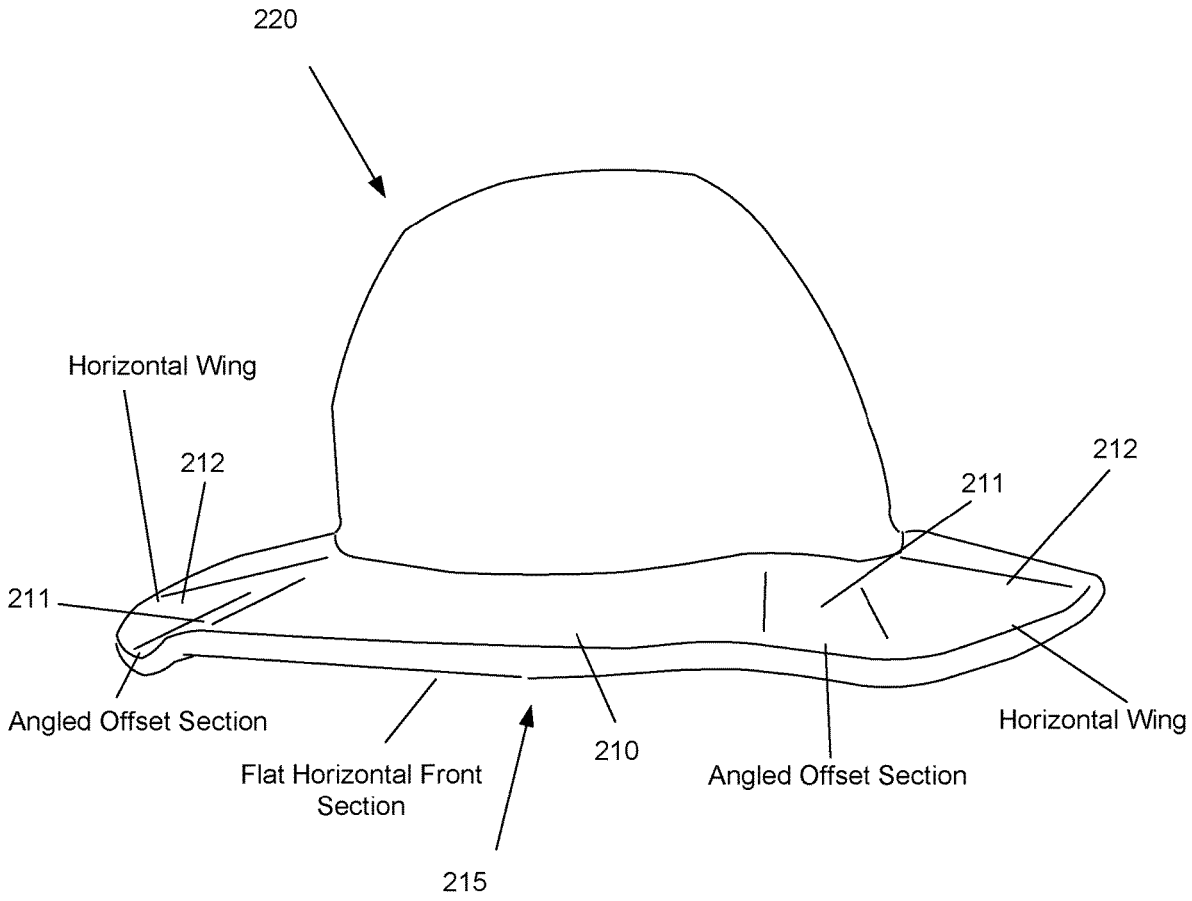

After being sewn into brim 215, winged visor 202 provides for an increased range of protection from the sun. Also, because wings 212 are flat and horizontal they do not interfere with the peripheral vision of the wearer and also prevent brim 215 from flopping up or down. Flattened front section 210 provides better shade for the user's eyes and face. Angled offset sections 211 provides for optimum connections to flat horizontal side wings 212. A perspective view of hat 220 with visor 202 sewn into brim 215 is shown in FIG. 41.

While the present invention has been described in terms of preferred embodiments, the reader should consider these described embodiments only as particular embodiments. Many other embodiments are possible. For example, even though FIG. 13 shows eyelets 23 in combination with visor 2 and removable chin strap 24, it should be understood that each of these items could be used independently on a variety of hat types. Eyelets 23 could be sewn into the crown of any hat and removable chin strap 24 could be applied to the brim of any hat. Also, winged visor 2 may be used in any sort of hat having a brim or a bill, including (but not limited to) ball caps, wide brim hats, and a variety of soft brimmed sun hats and other hats. Therefore, the reader should determine the scope of the present invention by the claims and their legal equivalents.

What is claimed is:

1. A winged visor stiffener for a hat's brim, comprising:

(A) a flat horizontal front section formed into said stiffener, (B) two angled offset sections formed into said stiffener and connected to said flat front section, (C) two flat horizontal wings formed into said stiffener, each said flat horizontal wing connected to one of said angled offset sections so that said two angled offset sections are sandwiched between said flat horizontal front section and said two flat horizontal wings, wherein said two flat horizontal wings are lower than said flat horizontal front section and wherein said two flat horizontal wings are parallel to said flat horizontal front section, (D) an upper brim cloth section, and (E) a lower brim cloth section, wherein said brim fully encircles the wearer's head, wherein said winged visor stiffener is sewn between said upper brim cloth section and said lower brim cloth section via a plurality of rows of tight stitching and wherein said winged visor stiffener provides protection to the wearer's face and optimizes peripheral vision, and wherein said brim is stiff where said winged visor stiffener is sewn between said upper brim cloth section and said lower brim cloth section thereby preventing said brim from flopping up and down and wherein said brim is not stiff where said winged visor stiffener is not sewn between said upper brim cloth section and said lower brim cloth section thereby permitting said brim to flop up and down.

2. The winged visor stiffener as in claim 1, wherein said winged visor is fabricated from flexible, bendable thin plastic.

3. The winged visor stiffener as in claim 1, wherein said flat horizontal front section is initially curved but becomes flat and horizontal after being sewn into said brim and wherein said two flat horizontal wings are initially tilted but become flat and horizontal after being sewn into said brim.

4. The winged visor stiffener as in claim 1, wherein each of said two flat horizontal wings comprises a back side wing edge that is at least 2 inches in length.

5. The winged visor stiffener as in claim 1, wherein said winged visor is sewn into the bill of ball cap.

6. The winged visor stiffener as in claim 1, wherein said winged visor is sewn into the brim of a wide brim hat.

7. The winged visor stiffener as in claim 1, wherein said winged visor is sewn into the bill of a visor.

8. A winged visor stiffener for a hat's brim, comprising:

(A) a flat horizontal front section formed into said stiffener, (B) two angled offset sections formed into said stiffener and connected to said flat front section, (C) two flat horizontal wings formed into said stiffener, each said flat horizontal wing connected to one of said angled offset sections so that said two angled offset sections are sandwiched between said flat horizontal front section and said two flat horizontal wings, wherein said two flat horizontal wings are lower than said flat horizontal front section and wherein said two flat horizontal wings are parallel to said flat horizontal front section, (D) an upper brim cloth section, and (E) a lower brim cloth section, wherein said brim fully encircles the wearer's head, wherein said winged visor stiffener is sewn between said upper brim cloth section and said lower brim cloth section via a plurality of rows of tight stitching and wherein said winged visor stiffener provides protection to the wearer's face and optimizes peripheral vision and wherein said brim is stiff where said winged visor stiffener is sewn between said upper brim cloth section and said lower brim cloth section thereby preventing said brim from flopping up and down and wherein said brim is not stiff where said winged visor stiffener is not sewn between said upper brim cloth section and said lower brim cloth section thereby permitting said brim to flop up and down.

9. The winged visor stiffener as in claim 1 or claim 8, wherein said flat horizontal front section, said two angled offset sections and said two flat horizontal wings are positioned to extend outward in front of the wearer's face.

* * * * *